US006484337B1

(12) United States Patent
Moe et al.

(10) Patent No.: US 6,484,337 B1
(45) Date of Patent: Nov. 26, 2002

(54) MULTIPURPOSE PILLOW ASSEMBLY

(75) Inventors: Peggy Michelle Moe, Raytown, MO (US); Jeffrey L. Criswell, Lee's Summit, MO (US)

(73) Assignee: Kisses From Heaven, Inc., Independence, MO (US)

( * ) Notice: Subject to any disclaimer, the term of this patent is extended or adjusted under 35 U.S.C. 154(b) by 0 days.

(21) Appl. No.: 09/921,374

(22) Filed: Aug. 2, 2001

(51) Int. Cl.[7] ..... A47C 16/00
(52) U.S. Cl. ..... 5/652; 5/653; 5/655; 5/657
(58) Field of Search ..... 5/630, 631, 632, 5/633, 652, 653, 655, 657; 297/9

(56) References Cited

U.S. PATENT DOCUMENTS

| | | | | |
|---|---|---|---|---|
| 726,164 | A | | 4/1903 | Hogan et al. |
| 941,143 | A | * | 11/1909 | Powell ..... 368/212 |
| 1,468,072 | A | * | 9/1923 | Ogle ..... 128/889 |
| 1,986,697 | A | | 1/1935 | Wilson |
| 2,085,296 | A | * | 6/1937 | Carey ..... 128/889 |
| 2,257,848 | A | * | 10/1941 | Larkin ..... 297/228.12 |
| 3,840,916 | A | | 10/1974 | Jennings |
| D255,966 | S | | 7/1980 | Stadel |
| 4,394,783 | A | * | 7/1983 | Simmons ..... 297/230.1 |
| 5,092,005 | A | | 3/1992 | Byrn |
| 5,154,649 | A | | 10/1992 | Pender |
| 5,519,906 | A | * | 5/1996 | Fanto-Chan ..... 5/631 |
| 5,581,833 | A | * | 12/1996 | Zenoff ..... 108/43 |
| 5,661,861 | A | * | 9/1997 | Matthews ..... 248/918 |
| 5,702,153 | A | * | 12/1997 | Pliska ..... 297/230.1 |

* cited by examiner

*Primary Examiner*—Michael F. Trettel
(74) *Attorney, Agent, or Firm*—Hovey Williams LLP

(57) ABSTRACT

A multipurpose pillow assembly (10) for supporting lamaze partners, including a coach (C) and a pregnant woman (W), during lamaze exercises and for supporting a newborn (N) while a care-giver (G) is feeding the newborn (N) is disclosed. The pillow assembly (10) includes a body pillow (12), an attachable seat pillow (14) removably coupled to the body pillow (12), and a normally unattached seat pillow (16). The attachable seat pillow (14) is removably coupled to the body pillow (12) by a pair of stretchable straps (28),(30).

24 Claims, 3 Drawing Sheets

MULTIPURPOSE PILLOW ASSEMBLY

BACKGROUND OF THE INVENTION

1. Field of the Invention

The present invention relates generally to support devices used when conducting activities associated with childbirth. More specifically, the present invention concerns a multipurpose pillow assembly usable for activities such as supporting lamaze partners, including a coach and a pregnant woman, during lamaze exercises and for supporting a newborn during feeding.

2. Discussion of Prior Art

When a care-giver is bottle-feeding or breast-feeding a newborn baby, it is desirable to support the weight of the infant as well as the arms of the care-giver. Prior art pillows have been developed for this purpose; however, these prior art pillows are problematic and have several limitations. For example, prior art pillows do not provide desired support for the care-giver's back or buttocks during feedings. Prior art pillows also do not securely attach to the care-giver therefore making it difficult for the care-giver to change positions while keeping both hands on the infant.

Lamaze exercises are designed to facilitate relaxation of a pregnant woman during various stages of labor associated with natural childbirth and typically require the participation of a lamaze partner to assist and coach the woman. Several of these exercises involve both partners seated on the floor with the coach applying pressure to the woman's lower back in an effort to relieve tension and pain therein. Some of the stages of labor can last several hours. It is therefore desirable to cushion and support both lamaze partners while seated on the floor and to facilitate applying pressure to the woman's lower back in a hands-free manner so that the coach's hands are free to target other portions of the woman's body during a prolonged and painful stage of labor. Prior art pillows that were not specifically designed for these purposes have been implemented; however, use of these pillows is problematic and the prior art pillows have several limitations. For example, prior art pillows do not provide support for the woman's buttocks that is secure from undesirable slippage and movement. Prior art pillows also do not securely attach to a lamaze partner therefore making it difficult for the partners to utilize any hands-free pressure applications or to quickly and easily change positions.

Known prior art pillows are further limited in that they are not useful for both supporting a newborn during feeding and for supporting lamaze partners during lamaze exercises. For example, prior art pillows are not versatile in that the support they provide is limited to one or two activities (e.g., prior art nursing pillows may support the newborn but they cannot simultaneously support the care-giver's back and/or buttocks). Similarly, prior art pillows that may support the lamaze partners' buttocks cannot simultaneously facilitate pressure application to one of the partner's back.

SUMMARY OF THE INVENTION

The present invention provides an improved multipurpose pillow assembly that does not suffer from the problems and limitations of prior art pillows set forth above. A first aspect of the inventive pillow assembly concerns a multipurpose pillow assembly that broadly includes a generally U-shaped body pillow adapted to extend at least partly around the midriff of a user, and a seat pillow removably coupled to the body pillow and attached thereto in a manner that enables the user to sit upon the seat pillow when the body pillow is at least partly around the midriff of the user.

A second aspect of the inventive pillow assembly involves a seat pillow that broadly includes a generally elliptically shaped cushion having a central opening and adapted to be sat upon by a user wherein the central opening is adjacent the user's perineal area when the user is sitting on the cushion, a cover substantially containing the cushion, and at least one stretchable strap coupled to the cover and operable to removably secure the cushion-filled cover relative to the user.

A third aspect of the inventive pillow assembly concerns a multipurpose pillow assembly for supporting lamaze partners, including a coach and a pregnant woman, during lamaze exercises and for supporting a newborn during feeding, and broadly includes an enclosable body pillow adjustable between a pregnancy position, wherein the body pillow is adapted to encircle the midriff of one of the lamaze partners, and a feeding position, wherein the body pillow is adapted to support the feeding newborn; and at least one seat pillow adapted to be sat upon by either lamaze partner when the body pillow is in the pregnancy position, said at least one seat pillow being removably coupled to the body pillow.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 1:
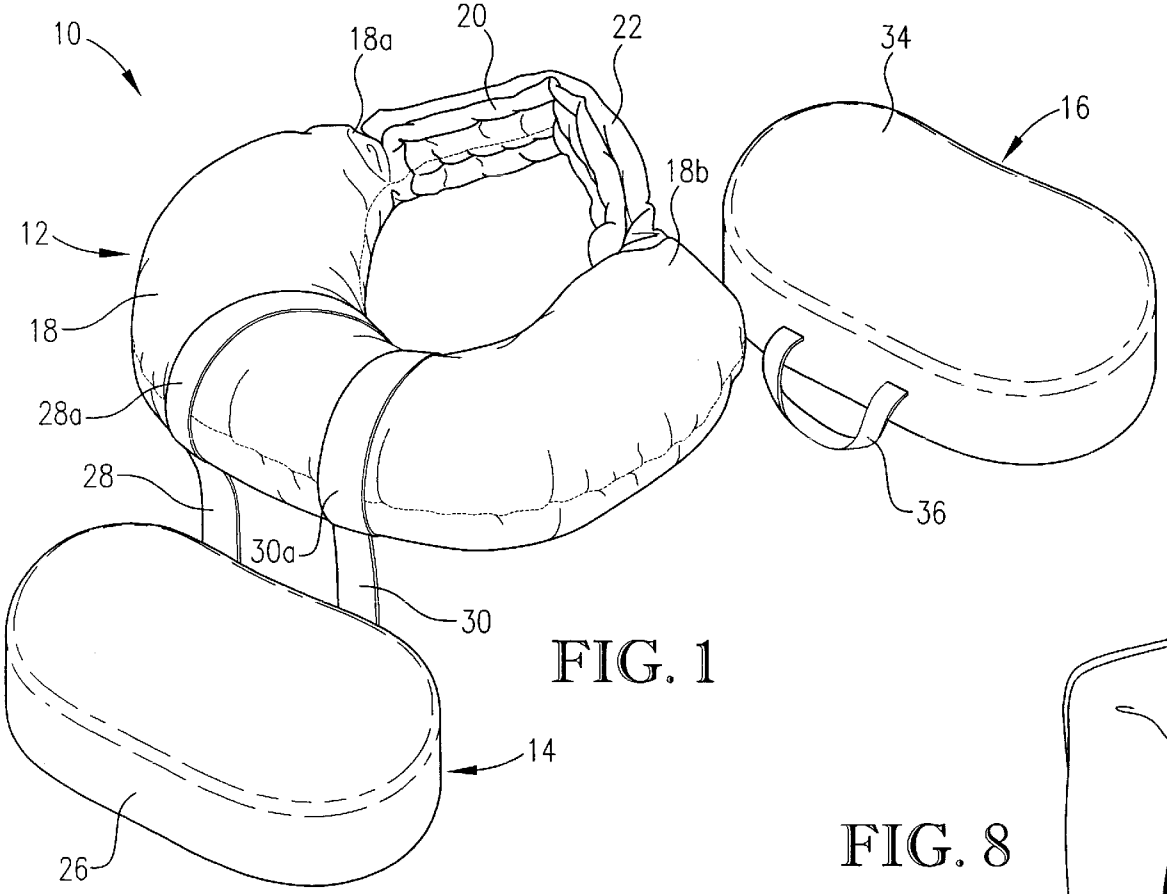
FIG. 1 is a perspective view of a multipurpose pillow assembly constructed in accordance with a preferred embodiment of the present invention.
Figure 8:
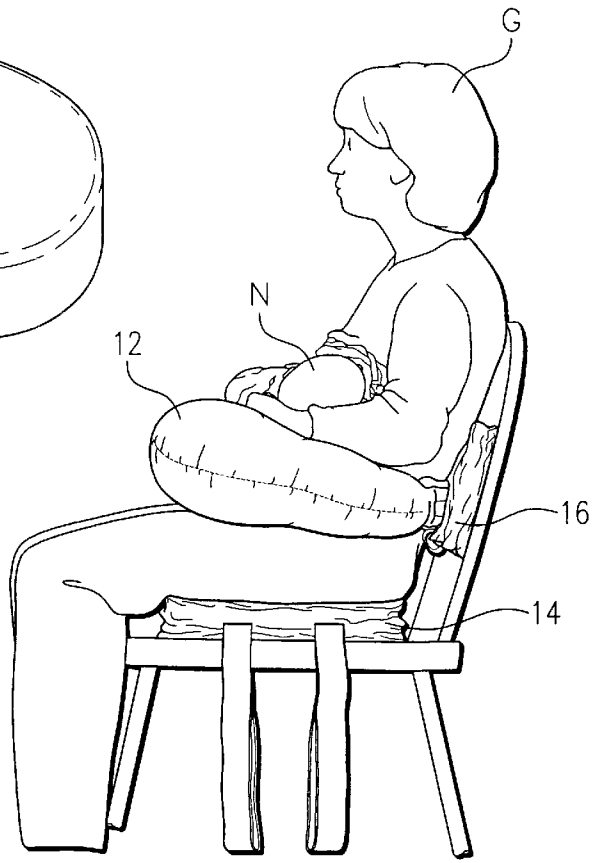
FIG. 8 is a side view of the multipurpose pillow assembly shown in use by a care-giver feeding a newborn.
Figure 6:
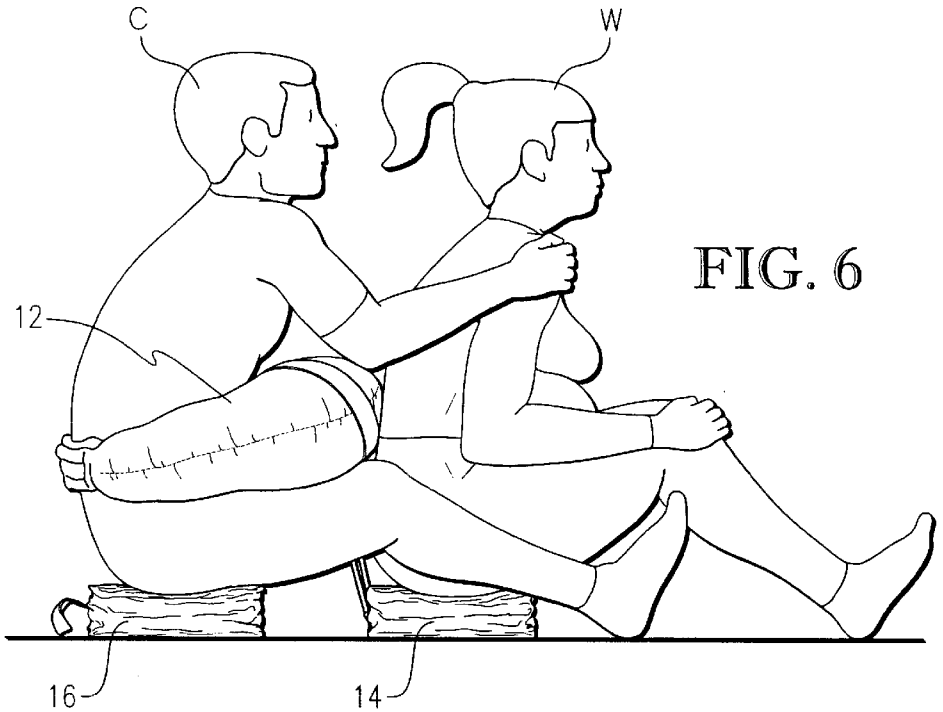
FIG. 6 is a side view of the multipurpose pillow assembly shown in use by lamaze partners performing a lamaze exercise.
Figure 7:
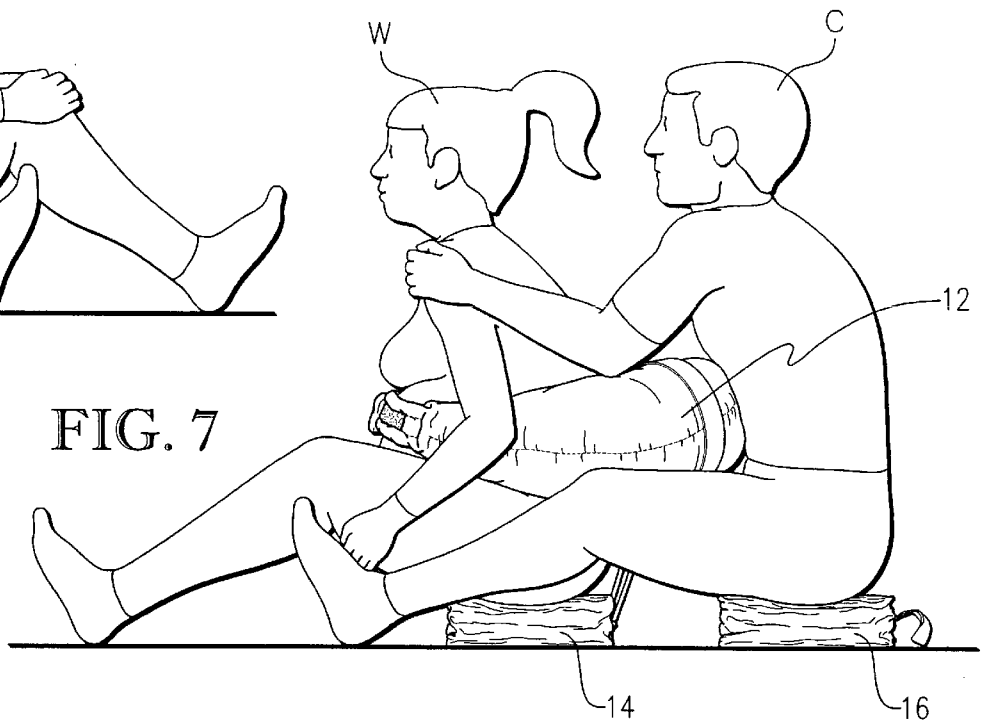
FIG. 7 is a side view of the multipurpose pillow assembly shown in an alternative use by lamaze partners performing a lamaze exercise.

FIG. 1 illustrates a multipurpose pillow assembly 10 constructed in accordance with a preferred embodiment of the present invention. As shown in FIGS. 6 and 7, the illustrated pillow assembly 10 is configured for supporting lamaze partners, including a coach C and a pregnant woman W, during lamaze exercises. As shown in FIG. 8, the illustrated pillow assembly 10 is also configured for supporting a care-giver G and a newborn N while the care-giver G is feeding the newborn N. The inventive pillow assembly is particularly suited for the illustrated uses; however, the inventive pillow assembly could be utilized as a support device by persons of all ages and sizes performing any activity facilitated by a support device. The illustrated multipurpose pillow assembly 10 broadly includes an enclosable body pillow 12, an attachable seat pillow 14 removably coupled to the body pillow 12, and a normally unattached seat pillow 16.

Figure 2:
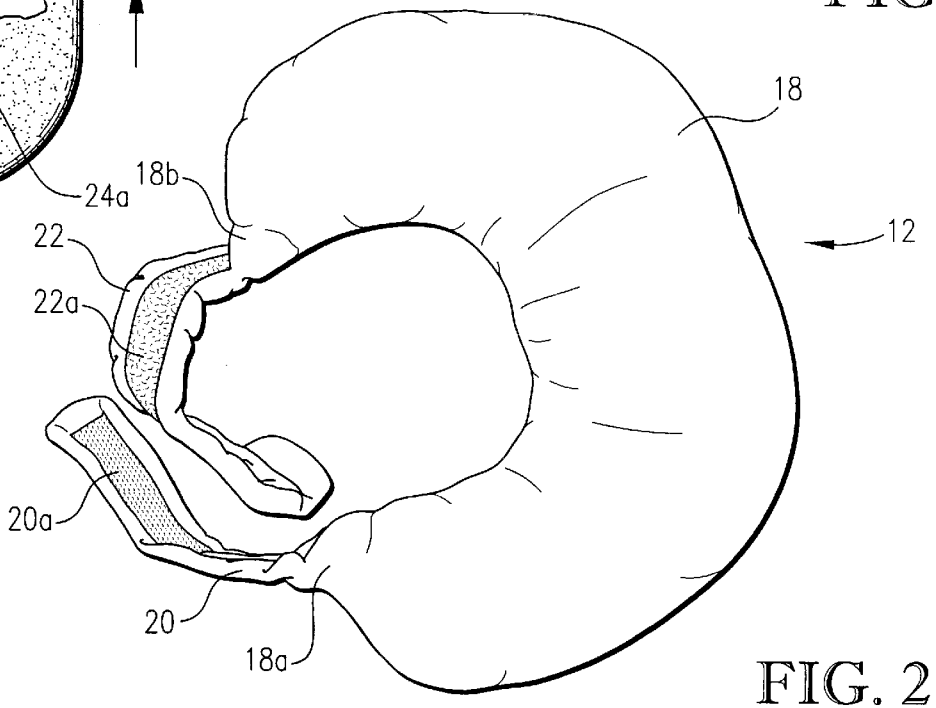
FIG. 2 is a plan view of the body pillow of the multipurpose pillow assembly.

Turning to FIGS. 1 and 2, the enclosable body pillow 12 includes a generally U-shaped cavity section 18 having ends 18*a* and 18*b*. The cavity section 18 comprises a durable case filled with a resilient filling. The case is preferably formed from fabric but could be formed from any suitable material such as leather, plastic, vinyl, etc. The resilient filling is preferably a solid compression-resistant material such as polyester filament but could also be any suitable filler such as air, water, non-polyester solids, etc. The case must be configured to retain the resilient filling (e.g., closed at any seam and at the ends 18*a*,18*b*) and if air or water is used as the filling, the case must be complementally configured (e.g., air-tight, water-tight, etc.). The cavity section 18 is configured to at least partially encircle the midriff of the user (e.g., the coach C, the pregnant woman W, the care-giver G, etc.) and support the newborn N thereon (see FIG. 8). Exemplary dimensions are described in U.S. Pat. No. 5,519,906 granted to Michelle M. Fanto-Chan on May 28, 1996 (assigned of record to the assignee of the present invention) and the Fanto-Chan '906 patent is herein incorporated by reference.

Each of the ends 18*a*,18*b* of the cavity section 18 adjoin a corresponding one of a pair of adjustable enclosing straps 20,22. The illustrated straps 20,22 each include a respective fastening strip 20*a*,22*a* that extends along substantially the entire length of the side of the corresponding strap 20,22 opposing the other so that the fastening strips 20*a*,22*a* complement one another (see FIG. 2). The straps 20*a*,22*a* are releasably attachable so that when they are attached together, the body pillow 12 fully encircles the user (see FIGS. 6–8). In particular, the illustrated strap 20*a* comprises a surface having a multitude of tiny hooks and the illustrated strap 22*a* comprises a complementary surface having an adhesive pile (e.g., Velcro); however, any suitable method of fastening the straps could be utilized such as buttons, hook-and-eye, zipper, etc. The illustrated straps 20*a*,22*a* are formed of fabric and are at least partially filled with a resilient filling; however, any suitable construction could be utilized (e.g., a single strap unitarily formed with the cavity section) so long as the straps are adjustably attachable together so as to encircle the user. The straps facilitate securing the body pillow to the user; however, this function could be accomplished without the need for enclosing straps. For example, the body pillow could be alternatively configured to generally retain its shape so that it is capable of fitting snugly around the user and remain thereon without the use of enclosing straps.

The body pillow 12 is adjustable between a pregnancy position as shown in FIGS. 6 and 7, wherein the body pillow 12 is adapted to encircle the midriff of one of the lamaze partners C or W, and a feeding position as shown in FIG. 8, wherein the body pillow 12 is adapted to support the feeding newborn N. The adjustable enclosing straps 20,22 are releasably attachable together when the body pillow 12 is in either the pregnancy position or the feeding position. It is desirable to support one or both of the lamaze partners when the body pillow 12 is in the pregnancy position and it is desirable to support the care-giver G when the body pillow 12 is in the feeding position.

Figure 5:
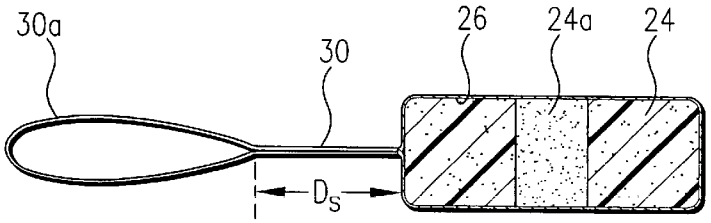
FIG. 5 is a sectional view of the attachable seat pillow taken substantially along line 5—5 of FIG. 4.
Figure 4:
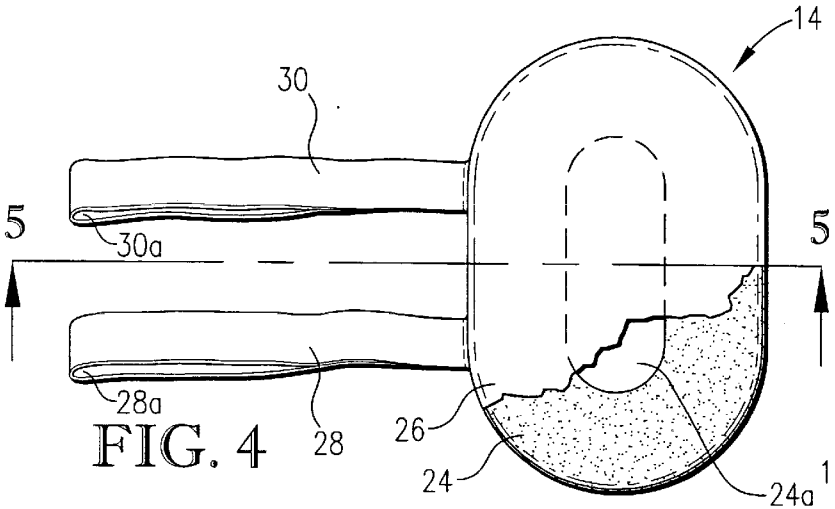
FIG. 4 is a plan view of the attachable seat pillow of the multipurpose pillow assembly.

In this regard, as shown in FIGS. 4 and 5, the attachable seat pillow 14 includes a generally elliptically shaped cushion 24 having a central opening 24*a* therein. The cushion 24 is formed of a solid compression-resistant material, preferably a polyester material; however, the material could be any suitable compression-resistant material. The cushion 24 and the central opening 24*a* are configured to support the buttocks of the user (e.g., either lamaze partner C or W, the care-giver G, etc.) without applying undesirable pressure against the perineal area of the user. The central opening 24*a* preferably has a length dimension greater than a width dimension with the length preferably ranging between 4" and 16" and most preferably 10" and the width preferably ranging between 2" and 6" and most preferably 4". In this manner, the attachable seat pillow 14 is particularly adapted to comfortably support a care-giver G who has recently given birth to a newborn N and may be suffering from the effects thereof (e.g., pain and discomfort associated with natural childbirth, an episiotomy, etc.). The cushion 24 is enclosed in a sheath 26 preferably formed of a durable material such as fabric, but could be formed of any suitable material such as leather, plastic, vinyl, etc. The sheath 26 could be configured in an air-tight or water-tight manner so that the resilient filling could alternatively comprise air, water, etc.

The attachable seat pillow 14 includes a pair of stretchable straps 28,30, spaced from one another, and attached to the sheath 26 at their proximate ends. Each of the straps 28,30 include a loop 28*a*,30*a*, respectively, formed in their distal ends and configured to removably couple the seat pillow 14 to the body pillow 12 (see FIG. 1). Particularly, the loops 28*a*,30*a* are sufficiently dimensioned to slip over one of the ends 18*a*,18*b* and onto the cavity section 18. The straps 28,30, when coupled to the body pillow 12, retain the positioning of the seat pillow 14 relative to the body pillow 12. In this manner, the attachable seat pillow 14 is prevented from undesirably slipping out from under the user during use of the pillow assembly 10 (e.g., during lamaze exercises as illustrated in FIGS. 6 and 7). The straps 28,30 are stretchable to provide some versatility in the positioning of the seat pillow 14 relative to the body pillow 12 so that the pillow assembly 10 can accommodate many different uses by variously sized users. The straps 28,30 are preferably dimensioned so that when they are coupled to the cavity section 18 generally towards the center thereof and the body pillow 12 is encircled around the midriff of one of the sitting paired users (e.g., the coach C, the woman W, etc.), the attachable seat pillow 14 can be positioned under the buttocks of the pregnant woman W as illustrated in FIGS. 6 and 7. The straps 28,30 each preferably have a separation dimension $D_S$ defined between the respective loop 28*a*,30*a* and the attachment with the sheath 26 (see FIG. 5) with a $D_S$ preferably ranging between 2" and 10" when in a relaxed, non-stretched state and most preferably 6", and with a $D_S$ preferably ranging between 6" and 18" when in a fully stretched state and most preferably 12". The straps 28,30 provide a removable coupling between the pillows 12,14 so that the seat pillow 14 can be removed from the body pillow 12 for applications when coupling thereof is undesired (e.g., to support the buttocks of a care-giver G when feeding a newborn N as illustrated in FIG. 8). The attachable seat pillow could utilize various alternative configurations, designs, and constructions, for example, the attachable seat pillow could include a single strap for coupling it to the body pillow, so long as the attachable seat pillow is operable to be removably coupled to the body pillow.

Figure 3:
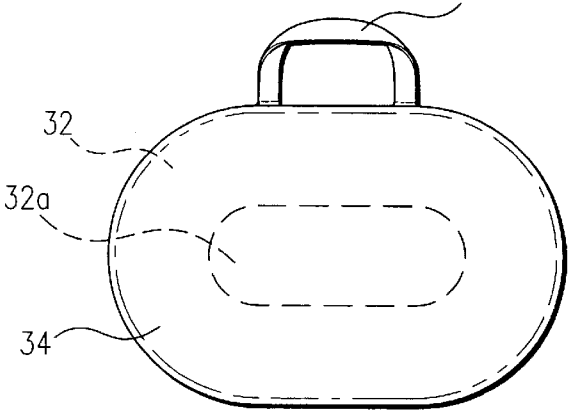
FIG. 3 is a plan view of the normally unattached seat pillow of the multipurpose pillow assembly.

As shown in FIGS. 1 and 3, the normally unattached seat pillow 16 includes a generally elliptically shaped cushion 32 having a central opening 32*a* therein. The cushion 32 is formed of a solid compression-resistant material, preferably a polyester material; however, the material could be any suitable compression-resistant material. The cushion 32 and the central opening 32*a* are configured to support the buttocks of the user (e.g., either lamaze partner C or W, the care-giver G, etc.) without applying undesirable pressure against the perineal area of the user. In this manner, the normally unattached seat pillow 16 is particularly adapted to comfortably support a care-giver G who has recently given birth to a newborn N and may be suffering from the effects thereof (e.g., pain and discomfort associated with natural childbirth, an episiotomy, etc.). The cushion 32 is enclosed in a sheath 34 preferably formed of a durable material such as fabric, but could be formed of any suitable material such as leather, plastic, vinyl, etc. The sheath 32 could be configured in an air-tight or water-tight manner so that the resilient filling could comprise air, water, etc.

The normally unattached seat pillow 16 is substantially similar in dimension and configuration to the attachable seat pillow 14. In this manner, the pillows 14,16 are adapted for uses wherein substantially similar support by each of the pillows 14,16 is desired (e.g., use by lamaze partners C and W performing lamaze exercises as illustrated in FIGS. 6 and 7). The normally unattached seat pillow 16, however, includes a handle 36 (rather than straps) attached to the sheath 34 to facilitate positioning and transport thereof. The handle 36 is preferably configured so that the pillow 16 can be attached to the body pillow 12 as is desirable for certain uses of the pillow assembly 10. For example, as shown in FIG. 1, the illustrated handle 36 is attached to the sheath 34 at both ends thereby defining an arcuate shaped handle providing a central opening between the handle 36 and the sheath 34. The opening is sufficiently dimensioned to receive the enclosing straps 20,22 of the body pillow 12 so that the normally unattached seat pillow 16 may be attached to the body pillow 12 as illustrated in FIG. 8. The normally unattached seat pillow could utilize various alternative configurations, designs, and constructions, for example, the pillow could include a double-strapped handle similar to the illustrated straps 28,30 of the attachable seat pillow 14 for coupling it to the body pillow, so long as the normally unattached seat pillow is operable to be removably coupled to the body pillow.

Operation

The multipurpose pillow assembly 10 has a multitude of uses and can be used as a single pillow, for example, using any pillow 12, 14, or 16 in isolation, or any combination thereof, depending on the application. For applications where attaching the seat pillow 14 to the body pillow 12 is desired, the straps 20,22 should be first released from one another as shown in FIG. 2. The loops 28*a*,30*a* of the stretchable straps 28,30 of the seat pillow 14 are then slipped over a respective strap 20,22 of the body pillow 12, over the corresponding end 18*a*,18*b* of the cavity section 18, and slid generally onto the center of the cavity section 18 of the body pillow 12 (see FIG. 1). To remove the attached seat pillow 14 from the body pillow 12, the above described steps are reversed.

The multipurpose pillow assembly 10 is particularly suited for supporting lamaze partners, for example the coach C and the pregnant woman W, during lamaze exercises. There are various lamaze exercises; however, many of these are focused on the coach C applying pressure to the lower back region of the pregnant woman W in an effort to alleviate aches and pains commonly associated with this region in pregnant women. This is typically conducted with the coach C positioned behind the woman W with both partners facing the same direction. In this regard, the body pillow 12 is wrapped around the midriff of one of the lamaze partners C or W so that the cavity section 18 is positioned therebetween. If the coach C is wearing the body pillow 12, the cavity section 18 will be positioned adjacent the coach's abdomen as shown in FIG. 6, and if the woman W is wearing the body pillow 12, the cavity section 18 will be positioned adjacent her lower back as shown in FIG. 7. The releasable straps 20,22 are attached together to secure the body pillow 12 in position. Particularly, the strips 20*a*,22*a* are generally aligned and pressed together. The dimensions of the straps 20,22 and strips 20*a*,22*a* thereon provide adjustability to the body pillow 12 so that it may be securely and/or loosely worn by variously sized coaches and women.

Applying pressure to the back of the woman W can be done with one or more of the partners in a sitting position and is commonly done with both partners in a sitting position. In this regard, the woman W is supported by the seat pillow 14 as shown in FIGS. 6 and 7. The seat pillow 14 is preferably attached to the body pillow 12 to prevent the attached seat pillow 14 from slipping out from under the woman W during the lamaze exercises. The previously described steps for coupling the pillows 12,14 can be implemented prior to one of the partners donning the body pillow 12. Alternatively, the woman W could first position herself on the seat pillow 14 and the coach C could release the straps 20,22 of the body pillow 12 and manipulate the positioning thereof to feed the strap 20 or 22 and the corresponding cavity end 18*a* or 18*b* through both loops 28*a*,30*a* of the stretchable straps 28,30. Once the straps 28,30 of the seat pillow 14 are in place, the straps 20,22 of the body pillow 12 are reattached to one another.

If both partners are in a sitting position, the coach C is preferably supported by the normally unattached seat pillow 16. This not only provides comfort and support for the coach C, but also facilitates an optimum positioning wherein both partners are at a substantially similar elevation relative to the floor. As illustrated in FIGS. 6 and 7, the multipurpose pillow assembly 10 not only provides support for the lamaze partners but also facilitates applying pressure to the lower back region of the woman W in a hands-free manner that allows the coach C the use of the hands for other purposes (e.g., manipulating the shoulders to increase the pressure on the lower back region, massaging other regions of the woman W, etc.).

The multipurpose pillow assembly 10 is also particularly suited for supporting the newborn N while the care-giver G is feeding the newborn N. Care-givers typically feed a newborn, either bottle-feeding or breast-feeding, while sitting in a chair with the newborn lying in their arms and/or lap. As illustrated in FIG. 8, the body pillow 12 is wrapped around the midriff of the care-giver G so that the cavity section 18 rests adjacent the lap of the care-giver G. The straps 20,22 can be adjustably attached to secure the body pillow 12 to the care-giver G. The newborn N can then be supported on the cavity section 18 of the body pillow 12 providing a comfortable and secure position for feeding. The seat pillows 14,16 can be utilized to support the care-giver G while feeding the newborn N, for example, the seat pillow 14 can support the buttocks of the care-giver G (either attached or unattached to the body pillow 12) and the seat pillow 16 can support the lower back of the care-giver G (either attached or unattached to the body pillow 12) as illustrated in FIG. 8. In order to attach the seat pillow 16 to the body pillow 12, the straps 20,22 are released, then positioned through the opening in the handle 36, and then reattached. Either seat pillow 14,16 is particularly adapted for supporting the buttocks of the care-giver G without applying undesired pressure against the perineal area.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A multipurpose pillow assembly comprising:

a generally U-shaped body pillow adapted to extend at least partly around the midriff of a user; and a seat pillow removably coupled to the body pillow and attached thereto in a manner that enables the user to sit upon the seat pillow when the body pillow is at least partly around the midriff of the user, said seat pillow having a central opening.

2. A multipurpose pillow assembly comprising:

a generally U-shaped body pillow adapted to extend at least partly around the midriff of a user; and a seat pillow removably coupled to the body pillow and attached thereto in a manner that enables the user to sit upon the seat pillow when the body pillow is at least partly around the midriff of the user, said seat pillow being generally elliptically shaped having a central opening.

3. The pillow assembly as claimed in claim 2, said seat pillow including a solid resilient filling.

4. The pillow assembly as claimed in claim 3, said seat pillow including a covering operable to contain the solid resilient filling.

5. The pillow assembly as claimed in claim 4, said seat pillow including at least one stretchable strap removably attaching the seat pillow to the body pillow.

6. The pillow assembly as claimed in claim 5, said at least one stretchable strap including a looped end operable to encircle at least a portion of the body pillow, said at least one stretchable strap being dimensioned so that when the looped end encircles a portion of the body pillow and the body pillow is at least partly around the midriff of the user, the seat pillow can be sat upon by the user.

7. The pillow assembly as claimed in claim 6, said seat pillow including an additional stretchable strap substantially similar to said at least one stretchable strap.

8. The pillow assembly as claimed in claim 7; and an additional seat pillow detached from the body pillow and seat pillow and adapted to be sold in a pillow assembly kit with the body pillow and the seat pillow.

9. A pillow assembly comprising:

a generally elliptically shaped cushion having a central opening and adapted to be sat upon by a user, wherein the central opening is adapted to be adjacent the user's perineal area when the user is sitting on the cushion;

a cover substantially containing the cushion;

a generally U-shaped body pillow adapted to extend at least partly around the midriff of a user; and at least one stretchable strap coupled to the cover and the body pillow.

10. The pillow assembly as claimed in claim 9; and an additional stretchable strap coupled to the cover and the body pillow and substantially similar to said at least one stretchable strap.

11. The pillow assembly as claimed in claim 10, said cushion being formed of a solid resilient material.

12. A method for supporting lamaze partners, including a coach and a pregnant woman, during lamaze exercises, the method comprising the steps of:

(a) wrapping a body pillow around the midriff of one of the lamaze partners; and (b) having the pregnant woman sit on a seat pillow, step (b) including the step of removably coupling the seat pillow to the body pillow.

13. The method for supporting lamaze partners as claimed in claim 12, step (b) further including the steps of placing a portion of the body pillow between the lamaze partners and attaching the seat pillow to the portion of the body pillow that is located between the lamaze partners.

14. A method for supporting lamaze partners, including a coach and a pregnant woman, during lamaze exercises, the method comprising the steps of:

(a) wrapping a body pillow around the midriff of one of the lamaze partners;

(b) having the pregnant woman sit on a seat pillow; and (c) having the coach sit on a seat pillow.

15. A method for supporting a newborn during feeding by a care-giver, the method comprising the steps of:

(a) wrapping a body pillow around the midriff of the care-giver;

(b) supporting the newborn with the body pillow; and (c) attaching a first seat pillow to the body pillow and having the care-giver lean back against the first seat pillow.

16. The method for supporting a newborn as claimed in claim 15, further comprising the step of:

(d) having the care-giver sit on a second seat pillow.

17. A multipurpose pillow assembly for supporting lamaze partners, including a coach and a pregnant woman, during lamaze exercises nad for supporting a newborn during feeding, the pillow assembly comprising:

an enclosable body pillow adjustable between a pregnancy position, wherein the body pillow is adapted to encircle the midriff of one of the lamaze partners, and a feeding position, wherein the body pillow is adapted to support the feeding newborn; and at least one seat pillow adapted to be sat upon by either lamaze partner when the body pillow is in the pregnancy position, said at least one seat pillow being removably coupled to the body pillow, said seat pillow having a central opening.

18. The pillow assembly as claimed in claim 17, said body pillow including adjustable enclosing straps releasably attachable together when the body pillow is in the pregnancy position.

19. The pillow assembly as claimed in claim 18, said straps each including a portion thereof filled with a solid resilient filling.

20. A multipurpose pillow assembly for supporting lamaze partners, including a coach and a pregnant woman, during lamaze exercises and for supporting a newborn during feeding, the pillow assembly comprising:

an enclosable body pillow adjustable between a pregnancy position, wherein the body pillow is adapted to encircle the midriff of one of the lamaze partners, and a feeding position, wherein the body pillow is adapted to support the feeding newborn; and at least one seat pillow adapted to be sat upon by either lamaze partner when the body pillow is in the pregnancy position, said at least one seat pillow being removably coupled to the body pillow, said seat pillow having a central opening, said body pillow including a cavity section having two closed ends.

21. The pillow assembly as claimed in claim 20, said cavity section being filled with a solid resilient filling.

22. The pillow assembly as claimed in claim 20, each of said ends adjoining a respective one of a pair of straps, said straps being releasably and adjustably attached together when the body pillow is in the pregnancy position.

23. A multipurpose pillow assembly for supporting lamaze partners, including a coach and a pregnant woman, during lamaze exercises and for supporting a newborn during feeding, the pillow assembly comprising:

an enclosable body pillow adjustable between a pregnancy position, wherein the body pillow is adapted to encircle the midriff of one of the lamaze partners, and a feeding position, wherein the body pillow is adapted to support the feeding newborn;

at least one seat pillow adapted to be sat upon by either lamaze partner when the body pillow is in the pregnancy position, said at least one seat pillow being removably coupled to the body pillow, said seat pillow having a central opening; and an additional seat pillow adapted to be sat upon by either lamaze partner when the body pillow is in the pregnancy position.

24. The pillow assembly as claimed in claim 23, said seat pillows each having a substantially similar thickness.

* * * * *